US005551854A

United States Patent [19]

Edwards

[11] Patent Number: 5,551,854

[45] Date of Patent: Sep. 3, 1996

[54] NON-CONTACT VANE-TYPE FLUID DISPLACEMENT MACHINE WITH CONSILIDATED VANE GUIDE ASSEMBLY

[76] Inventor: Thomas C. Edwards, 1426 Gleneagles Way, Rockledge, Fla. 32955

[21] Appl. No.: 556,669

[22] Filed: Nov. 13, 1995

Related U.S. Application Data

[63] Continuation of Ser. No. 268,083, Jun. 28, 1994, abandoned.

[51] Int. Cl.[6] ..... F04C 18/00

[52] U.S. Cl. ..... 418/265; 418/261

[58] Field of Search ..... 418/259, 260, 418/261, 265

[56] References Cited

U.S. PATENT DOCUMENTS 3,485,179 12/1969 Dawes ..... 418/265

FOREIGN PATENT DOCUMENTS 573060 6/1924 France ..... 418/265

0132088 7/1985 Japan ..... 418/261

1351 5/1872 United Kingdom ..... 418/261

*Primary Examiner*—Charles G. Freay

[57] ABSTRACT

A non-contact vane-type fluid-displacement machine includes a stator housing having an annular interior surface defining an interior bore and a rotor supported in an eccentric position in the interior bore of the stator housing relative to the annular interior surface thereof to undergo rotation relative to the stator housing about a central rotational axis. The rotor has at least one slot radially defined therein relative to the rotational axis. The machine also has at least one vane disposed in radial slot of the rotor. The vane is mounted to the rotor to undergo reciprocable movement in a radial direction relative to the rotational axis of the rotor such that an outer tip portion of the vane is maintained in a non-contacting substantially sealed relationship with the interior surface of the stator housing. Improved features of the machine relate to a plurality of low profile vane guide assemblies for positioning the vanes of the machine.

1 Claim, 15 Drawing Sheets

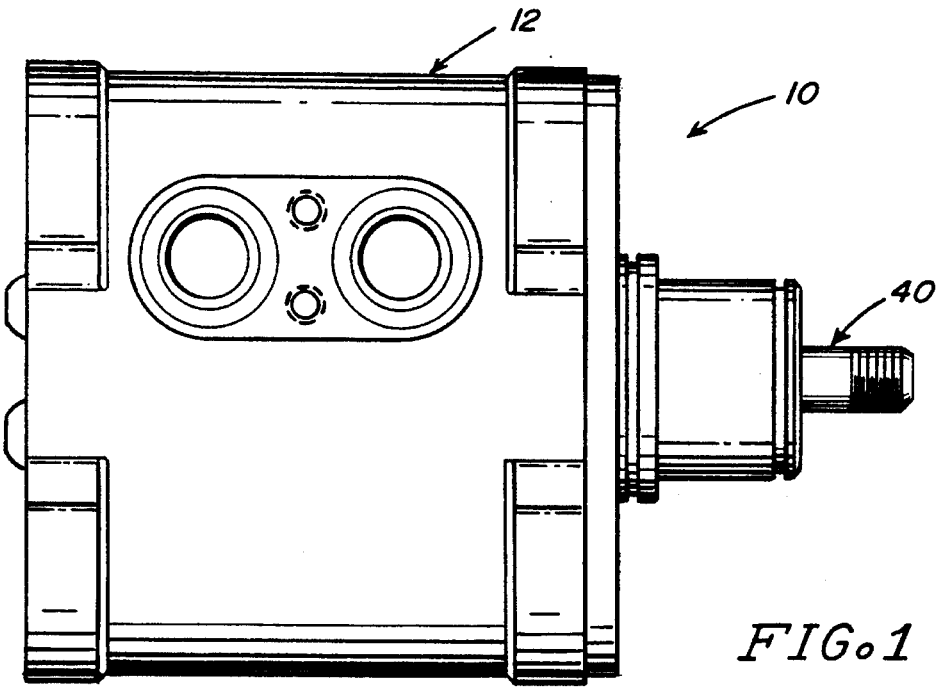
FIG. 1
FIG. 2
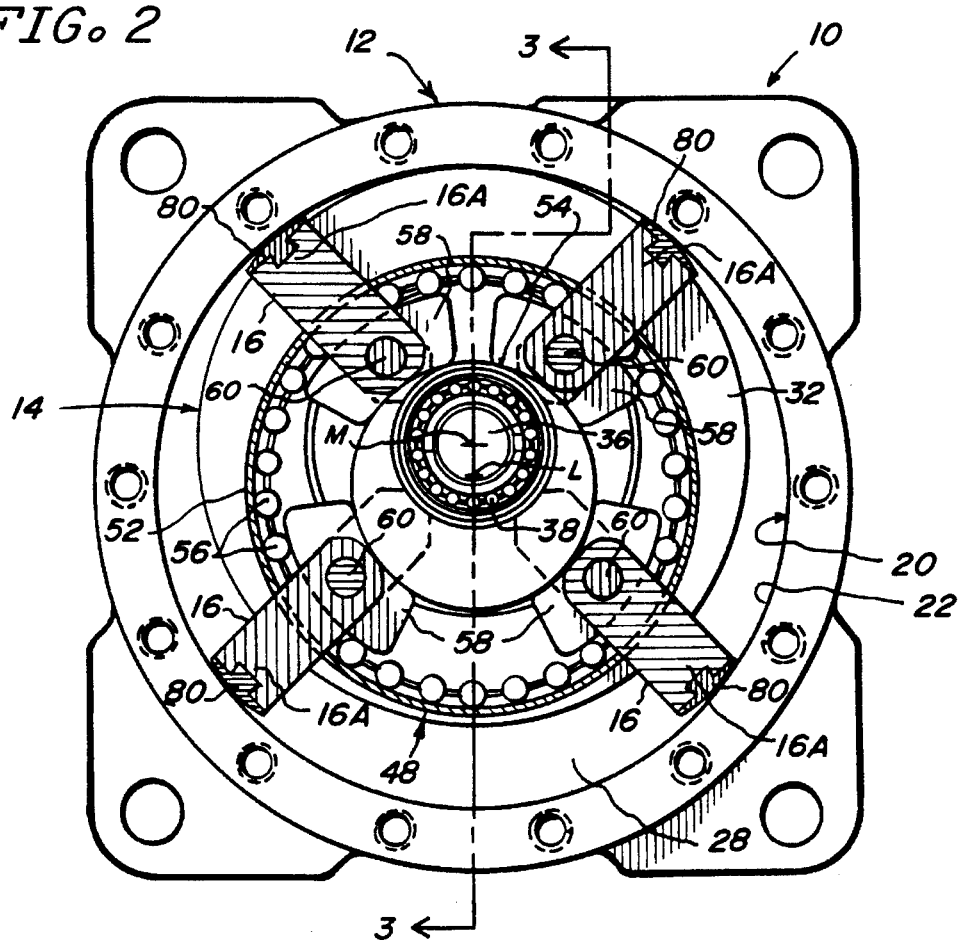

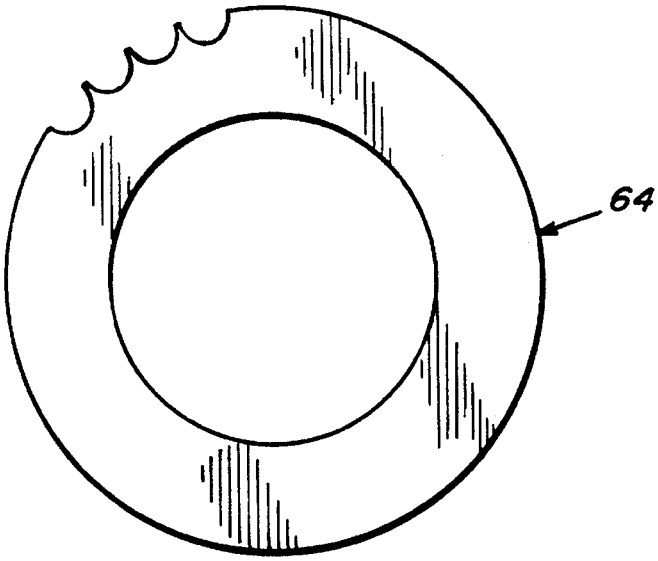
FIG. 10
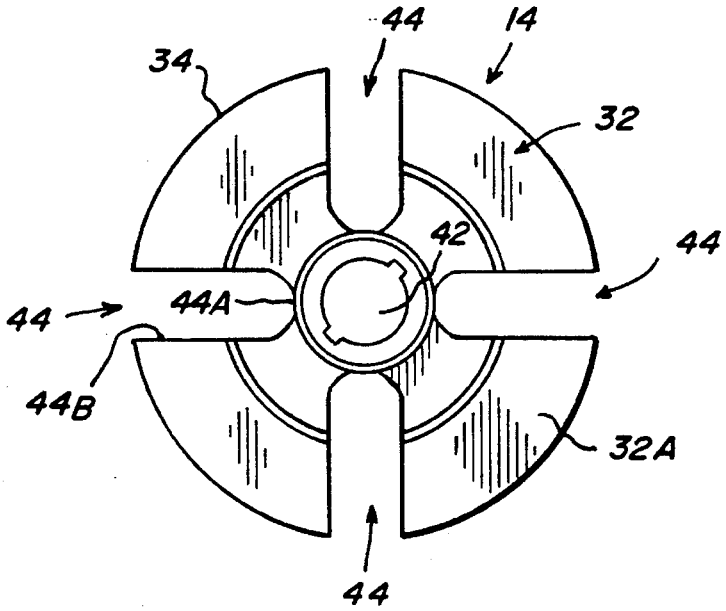
FIG. 9
FIG. 11
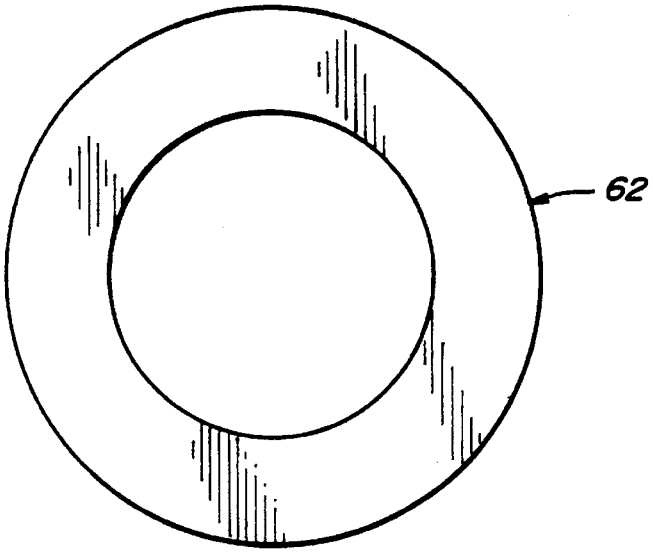

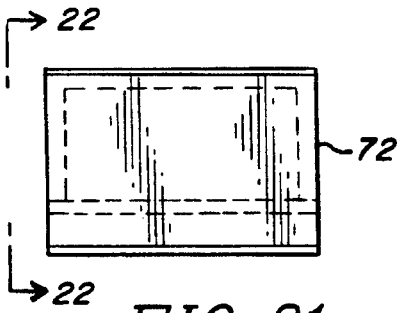
FIG. 21
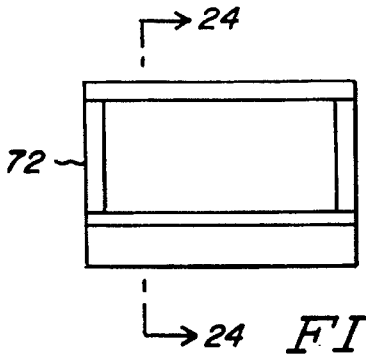
FIG. 23
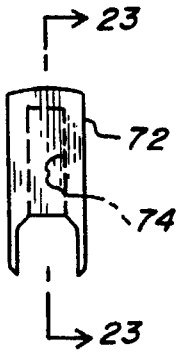
FIG. 22
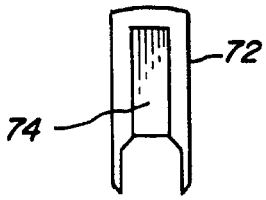
FIG. 24
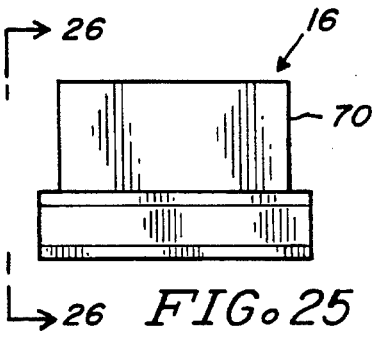
FIG. 25
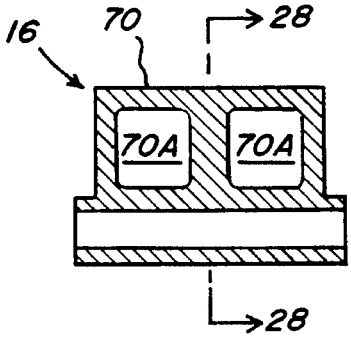
FIG. 27
FIG. 26
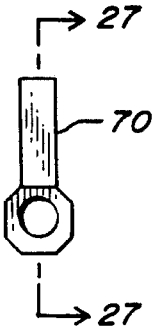
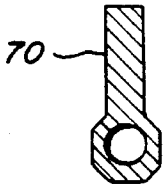
FIG. 28

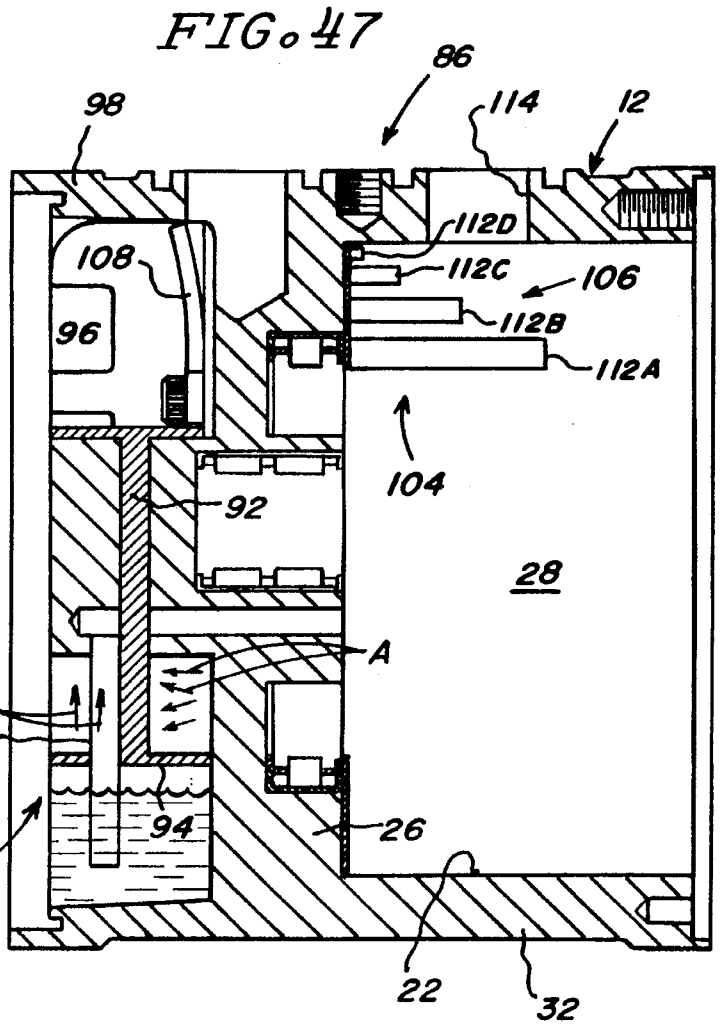
FIG. 47
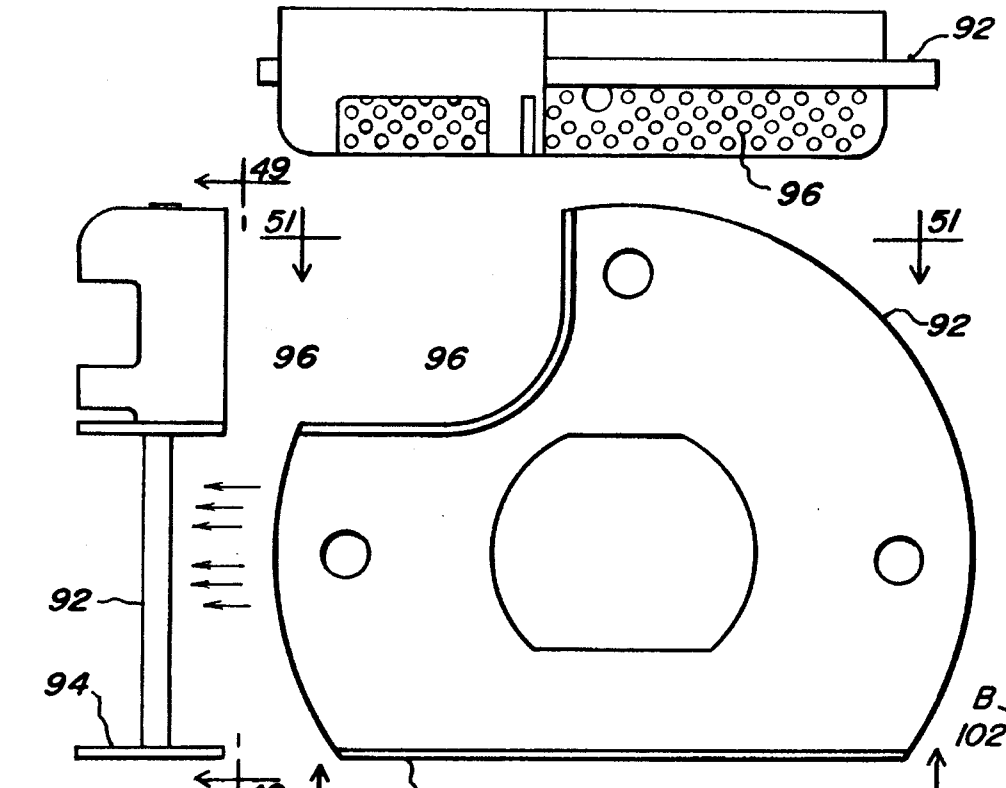
FIG. 48
FIG. 49
FIG. 50
FIG. 51

NON-CONTACT VANE-TYPE FLUID DISPLACEMENT MACHINE WITH CONSILIDATED VANE GUIDE ASSEMBLY

CROSS-REFERENCE TO RELATED APPLICATIONS

This application is a continuation of Ser. No. 08/268,083 filed Jun. 28, 1994, now abandoned.

Reference is hereby made to the following patent applications by the inventor herein which are copending with and related to the subject application:

1. "Non-Contact Vane-Type Fluid Displacement Machine With Rotor And Vane Positioning", assigned U.S. Ser. No. 08/268,074 and filed Jun. 28, 1994.
2. "Non-Contact Vane-Type Fluid Displacement Machine With Lubricant Separator And Sump Arrangement", assigned U.S. Ser. No. 08/267,983 and filed Jun. 28, 1994.
3. "Non-Contact Vane-Type Fluid Displacement Machine With Multiple Discharge Valving Arrangement", assigned U.S. Ser. No. 08/283,471 and filed Jun. 28, 1994.
4. "Non-Contact Vane-Type Fluid Displacement Machine With Suction Flow Check Valve Assembly", assigned U.S. Ser. No. 08/627,992 and filed Jun. 28, 1994.

BACKGROUND OF THE INVENTION

1. Field of the Invention

The present invention generally relates to fluid handling machines and, more particularly, is concerned with a non-contact vane-type fluid displacement machine having features of improved designs and constructions.

2. Description of the Prior Art

U.S. Pat. Nos. 5,087,183 and 5,160,252 to Thomas C. Edwards, also the inventor herein, disclose a non-contact vane rotary fluid displacement machine of unique design and superior performance in terms of reliability, economy and low noise characteristics. The machine can provide fluid displacement functions for numerous different consumer and industrial products. One important fluid displacement function of the machine is as a compressor. The provision of effective compression of gases in a compressor is a challenging technical and economic task. Commercially viable positive displacement compressors embody means for efficiently confining gases within dynamic sealing chambers formed by extremely close-fitting mechanical parts. For example, in conventional rotary-vane, screw, and scroll compressors, the side clearance between rotor faces and endplates are limited to about 0.0005 inch. For that reason, only a few types of compressors have reached commercial prominence. These compressors, to one degree or another, reach sufficient energy efficiency by achieving very small dynamic interface sealing clearances.

Not only are these tiny dynamic clearances difficult to achieve during manufacture, but as the pressure develops within the compressors when they are operating, the internal loads created by these operating pressures tends to increase these very small leakage gaps. Therefore, it is critical to design the compressors to not only achieve very close "cold" or non-operating clearances at manufacture, but to ensure that they do not increase significantly during operation. The latter can be achieved only through providing extremely rigid structural embodiments.

A characteristic of most compressor engineering and design is that it is not generally possible to achieve ideal design configurations that simultaneously present the highest efficiency and reliability at the lowest cost. Almost always, lower cost results in both lower energy efficiency and lower reliability. Thus, the innovator is faced with creating concepts and configurations that deal with economic constraints through knowledge of the relative importance of cost, reliability, and energy efficiency in a given compressor application.

A major application for a compressor is the automotive air conditioning compressor market. Due to its size and highly competitive nature, this market prefers compressors that are high energy efficiency, low in cost and have robustness. However, reliability is the predominant design requirement. Thus, high machine reliability predominates over energy efficiency from the standpoint of cost limitations.

The non-contact vane rotary fluid-handling machine of the above-cited Edwards patents has shown great promise as a compressor. However, further improvements in design and construction are desired to enhance the performance of this machine as a compressor, such as in the highly competitive automotive air conditioning compressor market.

SUMMARY OF THE INVENTION

The present invention of the subject patent application and the inventions of other patent applications cross-referenced above provide improvements in the construction and design of various features of the patented non-contact vane-type fluid displacement machine which satisfy the stringent requirements expected of compressors used in the automotive air conditioning compressor market. The improved designs and constructions of these features of the fluid displacement machine facilitate the achievement of a number of significant economies, namely, in terms of size, manufacturability, efficiency, and production economy. These economies arise from several sources, such as multiple use of the same parts, integral high-strength subcomponents, self-alignment of critical location parts, and self-forming zero-clearance no-load sealing interfaces.

In order to ensure as complete and thorough an understanding as possible, all improved features of the fluid displacement machine, both those constituting the invention claimed in the subject patent application as well as those constituting the inventions claimed in the patent applications cross-referenced above, are disclosed in detail herein. It should be understood that, even though the improved features are disclosed in the context of employment together in the same machine, most of these improved features also can be employed in separate applications.

In accordance with the present invention, improved features of the non-contact vane-type fluid displacement machine relate to at least a pair of separate vane guide assemblies for positioning at least one vane in a slot of the rotor. Each of the vane guide assemblies supports a portion of the one vane and is supported in one of a pair of annular channels arranged concentrically about a central rotational axis of the rotor and defined in one of the opposing flat interior wall surfaces of the stator housing. Each of the vane guide assemblies includes a pair of combined axle glider segments. Each of the combined axle glider segments has a stub axle portion and a ski portion. The stub axle portion of each combined axle glider segment fits through a separate portion of the length of an axial hole defined through an inner portion of the vane and said ski portion is disposed at the respective one of a pair of opposite ends of the vane and is supported in a respective one of the annular channels.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a top view of a non-contact vane-type fluid displacement machine incorporating components of improved construction in accordance with the present invention and the inventions of the applications cross-referenced above.

FIG. 2 is an enlarged cross-sectional view of the machine taken along line 2—2 of FIG. 1.

FIG. 9 is an end elevational view of a rotor of the machine as seen along line 9—9 of FIG. 4.

FIG. 10 is an end elevational view of one of a pair of thin compliant lubricous discs of the machine as seen along line 10—10 of FIG. 4.

FIG. 11 is an end elevational view of the other of the pair of thin compliant lubricous discs of the machine as seen along line 11—11 of FIG. 4.

FIG. 21 is a side elevational view of a sheath of the composite vane assembly of FIG. 16.

FIG. 22 is an end elevational view of the sheath as seen along line 22—22 of FIG. 21.

FIG. 23 is an axial sectional view of the sheath taken along line 23—23 of FIG. 22.

FIG. 24 is a cross-sectional view of the sheath taken along line 24—24 of FIG. 23.

FIG. 25 is a side elevational view of a structural body of the composite vane assembly of FIG. 16.

FIG. 26 is an end elevational view of the structural body as seen along line 26—26 of FIG. 25.

FIG. 27 is an axial sectional view of the structural body taken along line 27—27 of FIG. 26.

FIG. 28 is a cross-sectional view of the structural body taken along line 28—28 of FIG. 27.

FIG. 47 is an axial sectional view of a lubricant separator and sump arrangement of the fluid displacement machine of FIG. 1.

FIG. 48 is an end elevational view of a lubricant separator and filter element of the arrangement of FIG. 47.

FIG. 49 is a side elevational view of the lubricant separator and filter element as seen along line 49—49 of FIG. 48.

FIG. 50 is a lower end elevational view of the element as seen along line 50—50 of FIG. 49, showing a drain baffle thereon.

FIG. 51 is an upper end elevational view of the element as seen along line 51—51 of FIG. 49, showing an outlet baffle thereon.

DETAILED DESCRIPTION OF THE INVENTION

Non-Contact Vane-Type Fluid Displacement Machine

Figure 3:
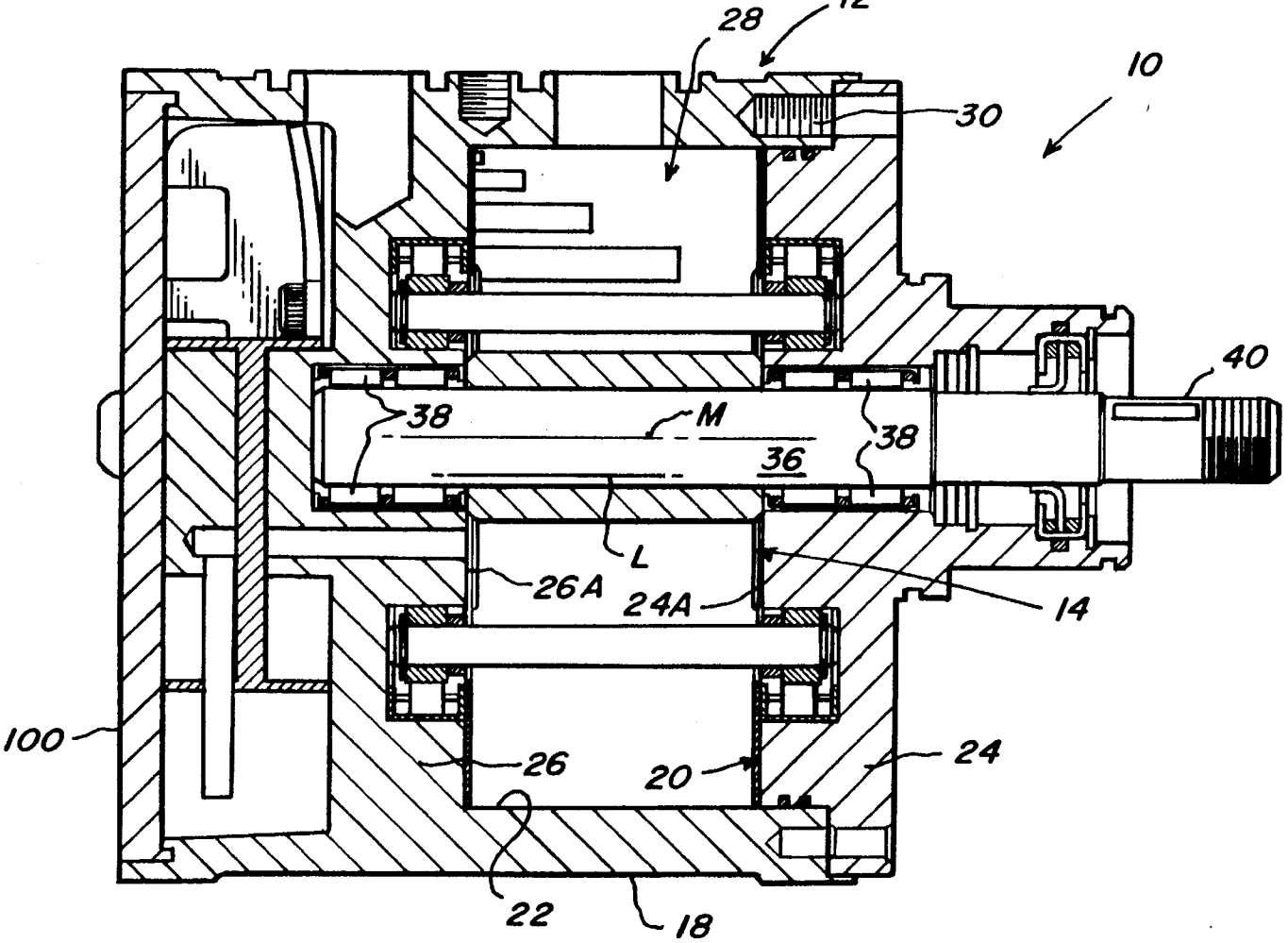
FIG. 3 is an axial sectional view of the machine taken along line 3—3 of FIG. 2.
Figures 4, 5, 6, 7, 8:
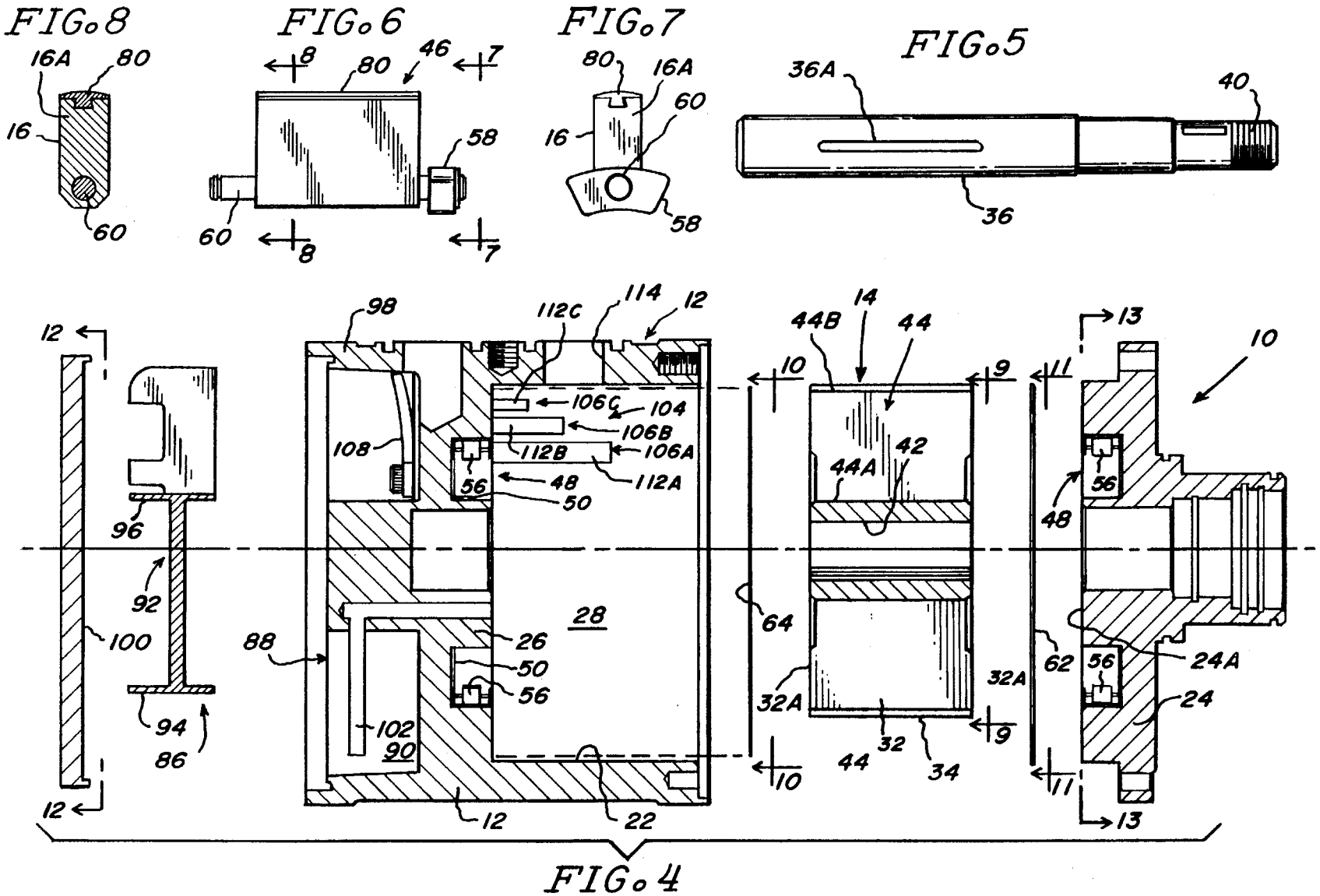
FIG. 4 is an enlarged exploded axial sectional view of the non-contact vane-type fluid-displacement machine of FIG. 1.
FIG. 5 is a side elevational view of a central shaft of the machine.
FIG. 6 is a side elevational view of one of the vane and guide assemblies of the machine.
FIG. 7 is an end elevational view of a vane and guide assembly of the machine as seen along line 7—7 of FIG. 6.
FIG. 8 is a sectional view of the vane and guide assembly taken along line 8—8 of FIG. 6.
Figure 12:
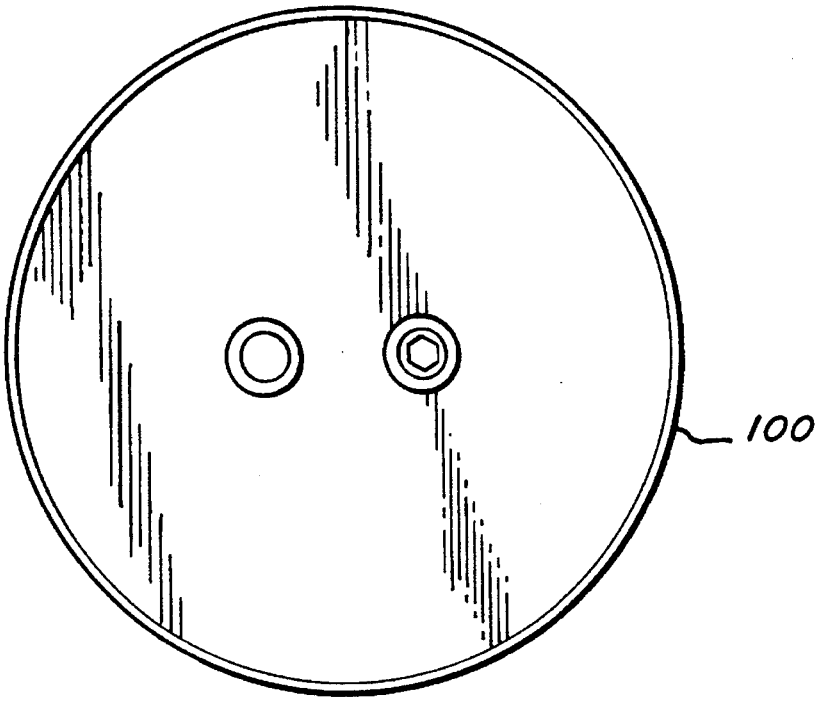
FIG. 12 is an interior end elevational view of a rear cover of the machine as seen along line 12—12 of FIG. 4.
Figure 13:
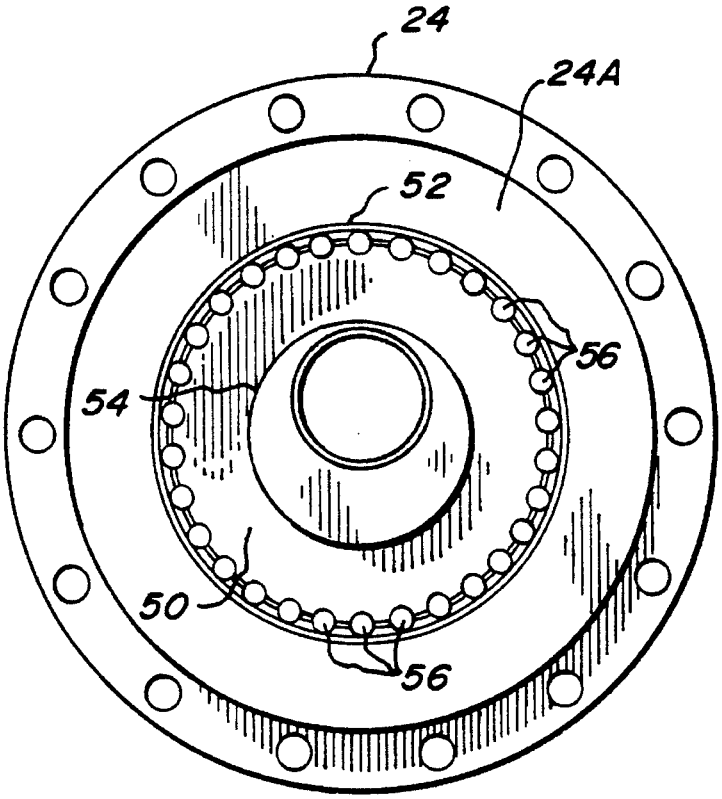
FIG. 13 is an interior end elevational view of a front endplate of the machine as seen along line 13—13 of FIG. 4.

Referring to the drawings and particularly to FIGS. 1–9, there is illustrated a non-contact vane-type fluid displacement machine, generally designated 10, adapted to incorporate features of improved construction respectively comprising the invention claimed in the subject patent application and the inventions claimed in the patent applications cross-referenced above. In order to ensure a complete and thorough understanding of the fluid displacement machine 10, all improved features of the fluid displacement machine 10, both those constituting the invention claimed in the subject patent application as well as those constituting the inventions claimed in the patent applications cross-referenced above, are disclosed in detail herein. An exemplary application for the fluid displacement machine 10 incorporating these improved features is as a compressor, for instance, as utilized in an automotive air conditioning environment.

Basically, the non-contact vane-type fluid displacement machine 10 includes a casing or stator housing 12, a rotor 14, and a plurality of radial vanes 16 movably mounted to the rotor 14. The stator housing 12 of the machine 10 includes a housing body 18 having an interior bore 20 defined by a cylindrical interior surface 22 being concentrically curved around a longitudinal axis L of the housing body 18. The interior bore 20 extends between opposite ends of the housing body 18 and has a generally right cylindrical shape. The stator housing 12 also includes a pair of endplates 24, 26 (26 being integral or non-integral with stator housing 12) closing the axial opposite ends of the interior bore 20 so as to define an enclosed cavity 28 within the stator housing 12. The one endplate 14 is removably attached by fasteners 30 across a front end of the housing body 18. The other endplate 26 located internally of the housing body 18 and intermediately between the opposite ends thereof is connected integrally with the housing body 18.

The rotor 14 of the machine 10 includes a generally right cylindrical body 32 having an exterior or outer cylindrical surface 34 curved concentrically around a longitudinal axis M of the rotor 14 and an elongated central shaft 36 which is rotatably mounted by bearings 38 to the front and intermediate endplates 24, 26 of the stator housing 12 and extends axially through the interior bore 20 thereof. The rotor body 32 is closely fitted over and stationarily keyed to the central shaft 36 which thereby positions and supports the rotor body 30 in the enclosed cavity 28 of the stator housing 12. The diameter of the rotor body 30 is substantially less than that of the internal bore 20 in the stator housing body 18 and the central shaft 34 is mounted to the endplates 24, 26 of the stator housing 12 such that the longitudinal axis M of the rotor body 32 is offset laterally from the longitudinal axis L of the stator housing 12. Thus, the central shaft 34 supports the rotor 14 in an eccentric position in the enclosed cavity 28 of the stator housing 12 relative to the interior surface 22 thereof to undergo rotation symmetrically about the longitudinal rotational axis M of the rotor 14 but asymmetrically about the longitudinal axis L of the stator housing 12. Also, the central shaft 26 of the rotor 14 has an input member, such as an input drive shaft portion 40, extending axially from one end thereof.

The rotor body 32 has a pair of opposite axial end surfaces 32A and an axial length preselected to be slightly less than the axial length of the interior bore 20 of the stator housing body 18. The rotor body 32 also has a central passage 42 formed therethrough which receives the central shaft 36 and a plurality of slots 44 formed therein extending radially relative to the longitudinal rotational axis M of the rotor body 32 and being circumferentially spaced from one another about the longitudinal axis M of the rotor body 32. The slots 44 have generally rectangular configurations with respective inner ends 44A that terminate in a radially outwardly spaced relationship from the central passage 42 through the rotor body 32 and outer ends 44B that terminate at the outer surface 34 of the rotor body 32. The slots 44 also extend longitudinally between opposite axial end surfaces 32A of the rotor body 32.

The plurality of vanes 16 of the machine 10 are generally rectangular in shape and are each disposed in one of the plurality of radial slots 44 defined in the rotor 14. Thus, the vanes 16 are circumferentially spaced from one another about the longitudinal axis M of the rotor body 32. The vanes 16 are mounted within the slots 44 so as to be radially reciprocable relative to the rotor 14 with the outer tip portions 16A of the vanes 16 being maintained in adjacent to but in non-contacting substantially sealed relationships with the interior surface 22 of the stator housing body 18.

The machine 10 also includes a vane guide assembly 46 for controlling the radial movement of the vanes 16 within the slots 44 of the rotor 14. The vane guide assembly 46 includes a pair of anti-friction roller bearings 48 disposed as mirror images of one another in annular channels 50 defined in the oppositely facing surfaces 24A, 26B of the front and intermediate endplates 24, 26 of the stator housing 12. Each of the bearings 48 of the vane guide assembly 46 includes an outer race 52, or inner race 54, a plurality of rollers 56 disposed between the outer and inner races 52, 54, a plurality of gliders 58 disposed between and movably mounted by the rollers 56 and the inner race 54, and a plurality of axles 60 mounted through the vanes 16 and rotatably supported at opposite ends by opposing pairs of the gliders 58 which, in turn, are movably mounted by the roller bearings 46. The above-described vane guide assembly 46 serves to precisely control, with generation of only minimum mechanical friction, the radial motion of the vanes 16 through the combined action of the axles 60, gliders 58 and freely-rotating annular roller bearings 48 disposed within the channels 50 of the end plates 24, 26. This arrangement enables the precise bi-axial radial motion control of the vane locations such that the outer tip portions 16A of the vanes 16 remain in exceedingly close and therefor gas sealing proximity, but essentially frictionless non-contacting relationship with the interior primary surface 22 of the stator housing body 18.

The above-described fluid displacement machine 10 has demonstrated superior performance in terms of reliability, economy and low noise characteristics. However, as will be described hereafter, in accordance with the invention claimed in the subject patent application and the inventions claimed in the patent applications cross-referenced above, the fluid displacement machine 10 is provided with features having improved constructions and designs which permit the fluid displacement machine 10 to achieve a number of significant economies, in terms of size, efficiency and manufacturability. One group of improved features of the non-contact vane-type fluid displacement machine relate to rotor and vane positioning and include a pair of members in the form of thin compliant lubricous discs employed at opposite ends of the rotor, a trepanned rotor providing balanced pressure on the vanes carried in slots of the rotor, and self-forming outer tip segments on the vanes. Another group of improved features make up an arrangement of multiple discharge valves in the stator housing of the machine. A further group of improved features make up a lubricant separator and sump arrangement incorporated in the stator housing of the machine. Still another group of improved features relate to a plurality of low profile vane guide assembly for positioning the vanes of the machine. A final improved feature is a suction flow check valve for use in the inlet of the stator housing of the machine.

Thin Compliant Lubricous Discs

Referring to FIGS. 3, 4, 9 and 10, there is illustrated a pair of planar lubricating or lubricious members constituting one improved feature incorporated by the machine 10. The planar lubricating members take the form of a pair of thin, compliant lubricous front and rear annular discs 62, 64 provided between the opposite flat end surfaces 32A of the rotor body 32 and the opposing flat interior wall surfaces 24A, 26A of the endplates 24, 26 of the stator housing 12. More particularly, these annular discs 62, 64 are bonded (or otherwise fixed to avoid rotation during operation) to the opposed facing interior wall surfaces 24A, 24B of the front and internal endplates 24, 26 of the stator housing 12 at opposite axial ends of the interior bore 20 through the housing body 18. The discs 62, 64 are made from suitable polymers, such as Teflon or thin metal with the dynamic side (inner-facing) covered with such materials.

These thin compliant lubricous annular discs 62, 64 behave as "dynamic gaskets" at the opposite axial end surfaces 32A of the rotor body 32 and opposite ends of the vanes 16, thereby providing important performance and manufacturing cost advantages. For example, superior sealing effects are easily achieved at the opposite axial end surfaces 32A of the rotor body 32 and opposite ends of the vanes 16 by the use of these discs 62, 64 without paying extreme attention to manufacturing tolerances. This occurs because of the nature of the compliant polymer veneer: it enables an interference fit of the rotating components. That is, the manufacturing dimensional tolerances of the compressor parts can be widened considerably (a minimum of 200% has proven to be easily achievable) because of the "resilient cushion" offered by the compliant polymer veneer. At the same time, the interference fit of the mating/sealing parts provides an extremely effective gas seal. Because of the low coefficient of mechanical friction offered by compliant low-friction polymers, such as Teflon, even the initial operating torque of the rotor/vane assembly remains relative small. Most important, however, the compressor actually completes its own axial-dimension "finish machining" to arrive at the ideal dynamic sealing interface: no-load/zero-clearance condition. That is, once the interface material interference is "squeezed" or otherwise displaced, no additional material is removed because the only axial forces simultaneously disappear with the disappearance of the material interference.

Trepanned Rotor Providing Balanced Pressure On Vanes

Figure 14:
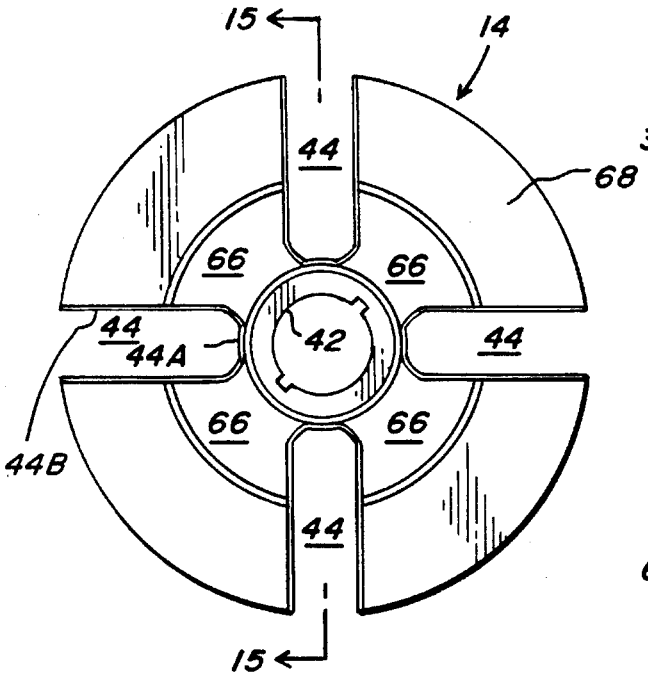
FIG. 14 is an end elevational view of a rotor of the machine having an improved construction.
Figure 15:
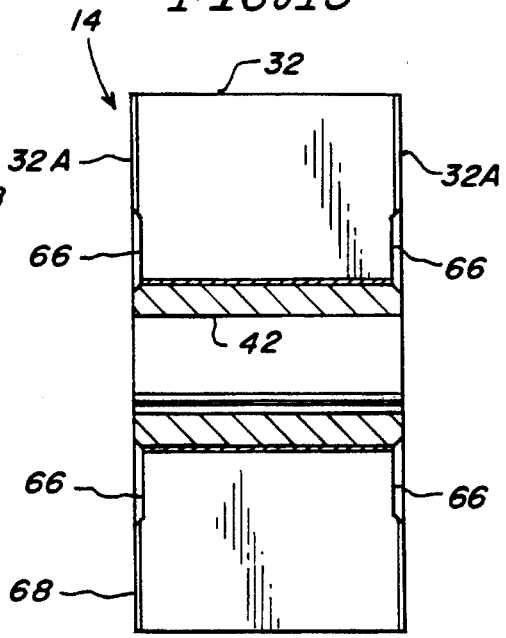
FIG. 15 is an axial sectional view of the rotor taken along line 15—15 of FIG. 14.
Figure 17:
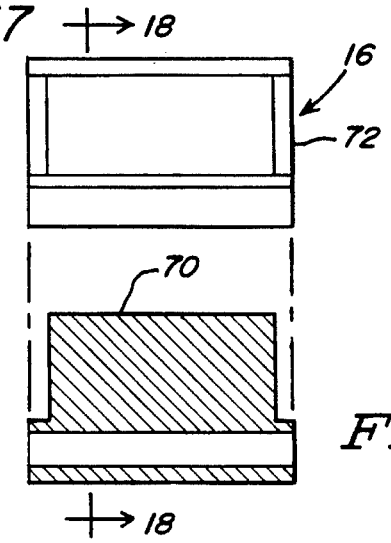
FIG. 17 is an exploded axial sectional view of the composite vane assembly of FIG. 16.
Figure 16:
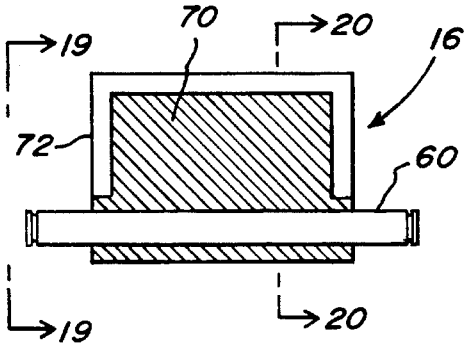
FIG. 16 is an axial sectional view of one embodiment of the composite vane assembly assembled with an axle.
Figure 18:
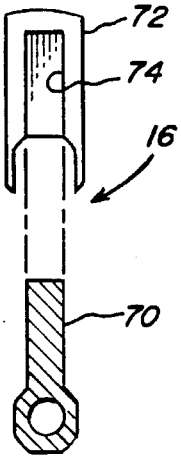
FIG. 18 is an exploded cross-sectional view of the composite vane assembly taken along line 18—18 of FIG. 17.
Figure 20:
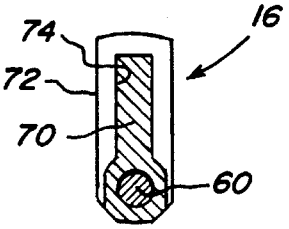
FIG. 20 is a cross-sectional view of the composite vane assembly as seen along line 20—20 of FIG. 16.
Figure 19:
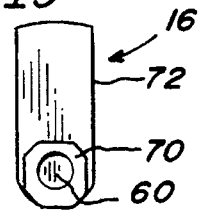
FIG. 19 is an end elevational view of the composite vane assembly as seen along line 19—19 of FIG. 16.
Figure 29:
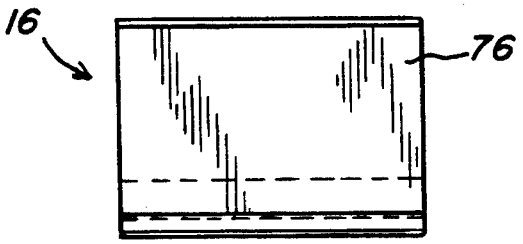
FIG. 29 is a side elevational view of another embodiment of the composite vane assembly.
Figure 30:
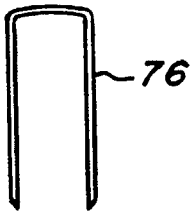
FIG. 30 is an end elevational view of a compliant wrap of the composite vane assembly of FIG. 29.
Figure 31:
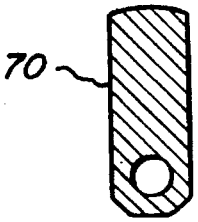
FIG. 31 is a cross-sectional view of a structural body of the composite vane assembly of FIG. 29.
Figure 32:
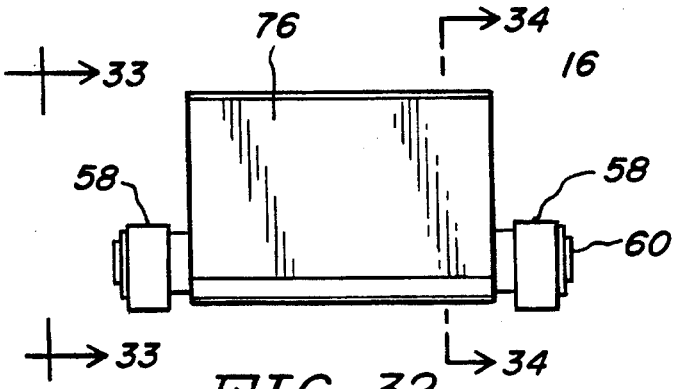
FIG. 32 is a side elevational view of the composite vane assembly of FIG. 29 assembled with an axle and glider pair.
Figure 33:
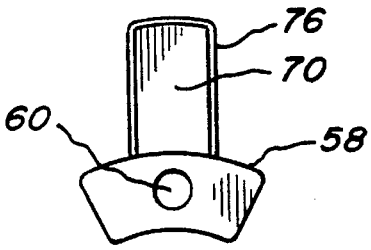
FIG. 33 is an end elevational view of the composite vane assembly as seen along line 33—33 of FIG. 32.
Figure 34:
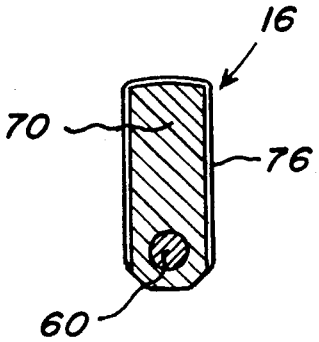
FIG. 34 is a cross-sectional view of the composite vane assembly taken along line 34—34 of FIG. 32.

Referring to FIGS. 14 and 15, there is illustrated another improved feature in the form of modifications made to the rotor 14 so as to provide control over the amount of outward radial pressure experienced by the underside (heel) of the respective vane 16 during the compression process. During the process wherein a given vane segment is undergoing compression, the vanes are receding into the vane slots. This circumstance offers a fortuitous advantage that results in quieter and more efficient machine operation. Collaterally, lower production costs are achieved by relieving several critical dimensional tolerances.

This situation can be taken advantage of by controlling the general level of pressure arising behind the vane 16 as it recedes into the rotor slot. The concept is very simple: by adding a formation of "trepanned" sections 66 to each axial end of the rotor 14 of appropriate depths. The function of these trepanned regions or sections 66 is to provide a controlled "venting" of the lubricant and gas that is dynamically displaced as the vane 16 recedes into the radial slot 44 during the compression stroke. This can occur because during the compression process, the vanes 16 are moving inwardly to displace the volume occurring underneath the vane 26. The deeper the trepanned sections 66 are, the easier it becomes for the under-vane fluid to be displaced out of the radial slot 44 and flow around the rotor shaft region and into the opposite (expanding or suction) vane slot 44. Thus, a deeper rotor end face trepan section 66 results in a lower dynamic pressure build-up under the vane 16.

On the other hand, a more shallow rotor face trepan makes it more difficult to rapidly empty the fluids occupying the open vane slot region. Thus, the dynamic pressure build-up under the vane will be higher and thus provide a larger outward radial pressure to maintain a net positive outward radial force on the vanes—and thus, on the OD of the gliders 58 against the glider bearings 48.

Ideally, the dynamic pressure build-up should be only slightly higher than the maximum net vane tip pressure. Thus, the net radial inward forces caused by the rising pressure experienced by the vane tip during compression will be only slightly less than the pressure exerted by the fluids in the slots. This condition will ensure quiet operation because the vane gliders 58 will not have to shift their loads back to the glider hubs 24 and 26 during the compression process. A trepan depth in the range of 0.020 to 0.080 inch has proven acceptable to provide the desired amount of venting depending upon operating conditions.

As also shown in FIGS. 14 and 15 is the addition of a bonded veneer 68 of seal and wear material to the rotor slot faces and to the faces of the rotor 14. Veneering these surfaces with Teflon has proven to offer excellent performance.

Not having to depend upon the mechanical outward location of the vane and guide assembly by the precision dimensions of both the glider undersurface radius and the glider hub diameter relieves two critical dimensional tolerances and, thus, lowers further the manufacturing cost of the compressor.

Self-Forming/Self-Dimensioning Vane Assemblies

Referring to FIGS. 16–46, there is illustrated various improved features in the form of different embodiments of composite (metal/thermo-resin sheathed or veneered) vane assemblies 46 which possess especially good mechanical and performance properties and thus improve the performance of the fluid displacement machine 10. These improved properties have been fostered by the specific difficulties that arise in the use of aluminum in the manufacture of very closely-fitting compressor parts. As is well-known, aluminum, which possesses especially attractive weight and strength properties, also has a very large coefficient of thermal expansion. Further, aluminum has very poor dynamic load-carrying (rubbing) properties. This is especially problematical when two aluminum parts must operate together as is the case of the machine 10.

One well-known method of dealing with this handicap is to coat the aluminum parts with a material that can withstand rubbing without allowing galling or related failure to occur. For example, the aluminum parts can be hard-anodized and, in some cases, this hard anodize coating is itself coated with materials such as fluoropolymers. This process results in a thin coating (~0.002 inch) of aluminum oxide, a very hard and wear-resistant substance. Unfortunately, hard-anodized aluminum parts do not tend to work well together if the relative velocities and loads between the mating parts reach high values, such as may be momentarily encountered between the vane tip and stator housing ID of the compressors if the tip touches.

This actual situation can occur under several circumstances. One is simply when the accumulated, or stack-up, tolerances of the compressor's parts are such that vane tip interference (touching) is caused. Under such a situation, the vane tip, traveling very rapidly, will damage both itself and the interior of the stator housing. Also, in the event that the stack-up tolerance is such that only a very small gap exists between the vane tip and stator wall, and the rotor is run at very high speeds, centrifugal and vane heel pressure forces could "stretch" the vane guide assembly enough to initiate vane tip contact. This condition will, of course, also cause damage.

In addition, but to a significantly lesser degree, the sides (axial ends) of the vanes 16 also pose the possibility of damage to themselves and the inner surface of both end plates of the compressor. This threat also exists because of the very high relative velocities of the vanes with respect to the stationary end plates, but is considerably less of a potential problem because there is always a known positive clearance at the sides. Nonetheless, side interference can occur and result in damage.

The solution to this dilemma is the several embodiments of the composite vanes 16 shown in FIGS. 16–46. The underlying concept of these embodiments is simple: combine a structural "backbone" or support body 70 with either a relatively thin lamination or sheath 72 of a suitable material that is benign to aluminum or hard-coated aluminum in the event severe dynamic rubbing is encountered. This composite material arrangement takes maximum advantage of the structural and matching thermal expansion properties of the aluminum and accommodates the general wear incompatibility of aluminum against aluminum. And, as pointed out earlier, these innovations not only increase performance and reliability, but also decrease production costs by substantially relieving important manufacturing tolerances.

FIGS. 16–28 illustrate one embodiment of the composite vane assembly 46 having the aluminum structural backbone or body 70 inserted vertically into the polymer resin sheath 72. The vane sheath 72 has an internal pocket 74 which accommodates insertion of the structural body 70. These two vane assembly parts can be bonded together in a manner well-known to those in the adhesive arts. In FIG. 27, the structural body 70 is shown having a pair of essentialy square internal cores 70A cast therein. These reliefs offer a simple means of reducing both the cost and weight of the composite vane assembly 46.

Figure 35:
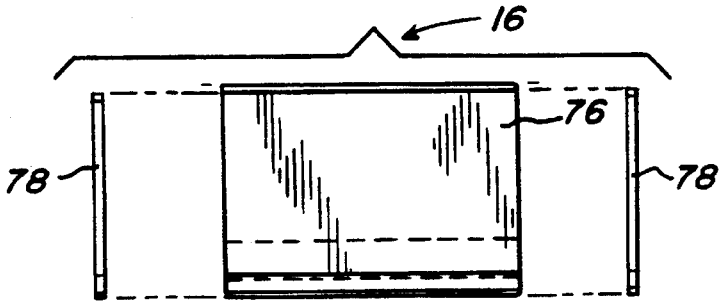
FIG. 35 is a side elevational view of still another embodiment of the composite vane assembly employing a pair of identical compliant end pieces.
Figure 36:
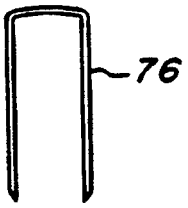
FIG. 36 is an end elevational view of a compliant wrap of the composite vane assembly of FIG. 35.
Figure 37:
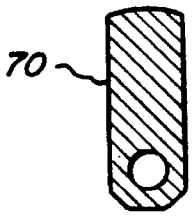
FIG. 37 is a cross-sectional view of a structural body of the composite vane assembly of FIG. 35.
Figure 38:
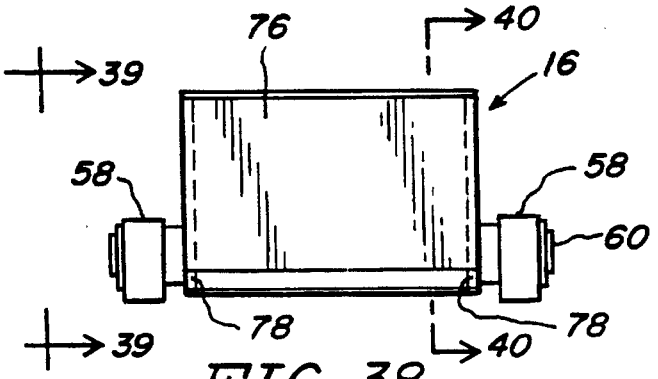
FIG. 38 is a side elevational view of the composite vane assembly of FIG. 35 assembled with an axle.
Figure 39:
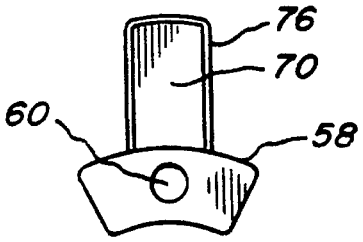
FIG. 39 is an end elevational view of the composite vane assembly as seen along line 39—39 of FIG. 38.
Figure 40:
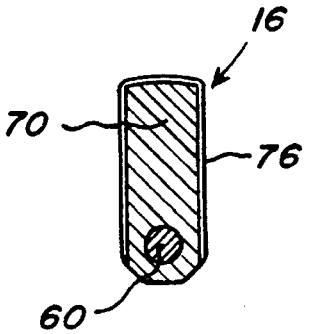
FIG. 40 is a cross-sectional view of the composite vane assembly taken along line 40—40 of FIG. 38.

FIGS. 29–40 illustrate another embodiment of the composite vane assembly 46 having a compliant wrap 76 (being shown already formed into a "U" channel shape) fittable over the vane body 70 and bonded thereto with appropriate engineering adhesives, such as Hysol epoxy. FIG. 35 shows the addition of two identical compliant vane end pieces 78 which are placed in the void made by the short extended ends of the compliant wrap 76 and bonded to the ends of the vane body 70. This combination offers an attractive means by which to capture the end pieces 78 and hold them in place for bonding. Of course, these compliant end pieces 78 protect the running end surfaces of the vanes 16 from wear and damage.

FIGS. 41–46 illustrate yet another, but simplier, preferred embodiment of a composite vane assembly 46. This embodiment includes an aluminum vane "blank" that has installed on its tip a further improved feature of the fluid displacement machine 10 in the form of a dove-tailed (or other suitable interlocking arrangement well-known to the art) self-forming vane outer tip segment 80. The outer tip segment will also be made from materials, such as Teflon or other polymer resins, that will benignly absorb wear resulting from vane tip contact. Of course, the outer tip segment 80 will be completely self-formed to no-load zero sealing clearance within a short time of operation and will occur when the vane gliders 58 seat fully against the glider bearing 48. This seating occurs as the vane tip material is sacrificed (self-formed) until all the radial forces on the vane are transferred to the vane gliders. It is important to note that the reason that "self-machining" can be employed in the machine 10 is because the radial loads of the vanes are taken up by the glider and bearing arrangement. Once the vane tips have "worn in" to zero-load/zero clearance, there is virtually no vane tip friction, but excellent gas sealing—all without having to hold tight manufacturing tolerances.

Figure 41:
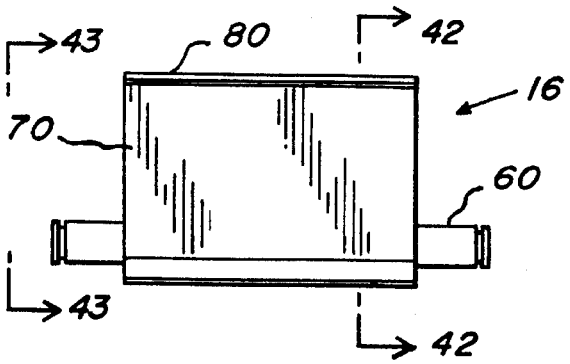
FIG. 41 is a yet another embodiment of a composite vane assembly having a vane tip segment for self-forming the tip of a vane.
Figure 42:
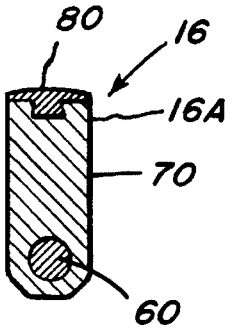
FIG. 42 is a cross-sectional view of the composite vane assembly taken along line 42—42 of FIG. 41.
Figure 43:
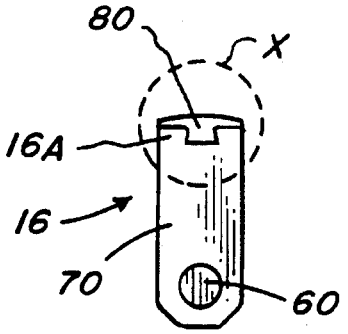
FIG. 43 is an end elevational view of the composite vane assembly as seen along line 43—43 of FIG. 41.

The particular configuration shown in FIGS. 41–43 has the especially attractive option of being able to offer an outer tip segment 80 that can be easily extruded—as can the vane tip portion. Further, and again as noted above, the sacrificial tip segment 80 can be constructed of materials that will provide essentially zero tip clearance through a short run-in process. That is, the tip segment 80 can be installed such that the vane tip itself is slightly long (several thousands of an inch) so that the tip actually presses against the inside of the stator housing wall when the machine is first assembled.

Upon running, the excess material will be brushed and burnished away as it rubs against the stator wall until a condition of zero clearance is achieved. This is easily achievable because the radial position of the vanes are precisely defined by purely mechanical means. That is, because the radial location of the vanes are precisely limited, when the excess vane tip material is removed, simultaneously, the vane cannot move out radially any further than the mechanical constraints will allow—the result thus being an essentially zero-clearance vane tip with essentially no residual friction after the initial "break-in".

Figure 44:
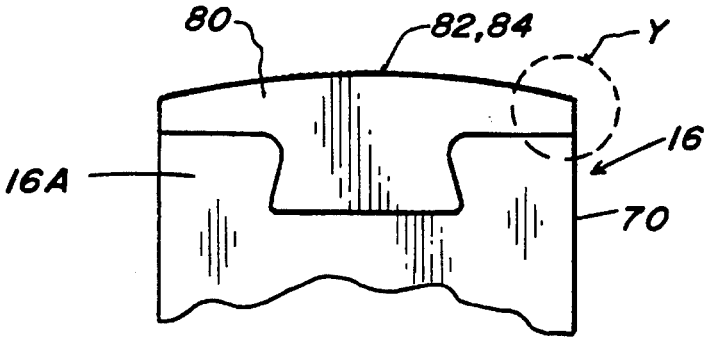
FIG. 44 is an enlarged fragmentary detailed view of the portion of the composite vane assembly encompassed by circle X in FIG. 43.
Figure 45:
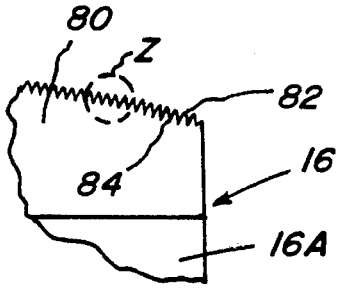
FIG. 45 is an enlarged fragmentary detailed view of the portion of the composite vane assembly encompassed by circle Y in FIG. 44.
Figure 46:
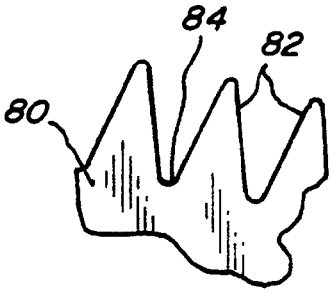
FIG. 46 is an enlarged fragmentary detailed view of the portion of the composite vane assembly encompassed by circle Z in FIG. 45.
Figure 54:
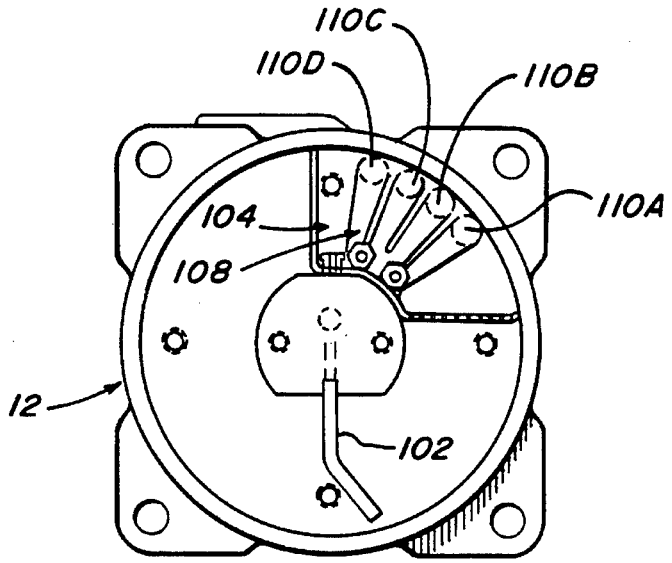
FIG. 54 is an opposite end elevational view of the multiple discharge valving arrangement as seen along line 54—54 of FIG. 52.
Figure 53:
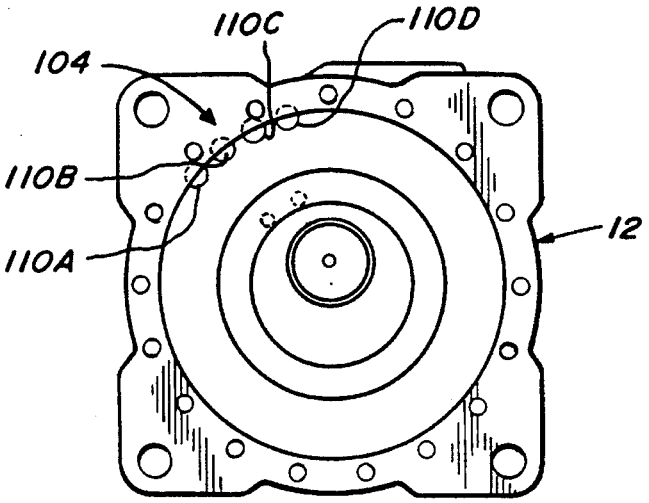
FIG. 53 is an end elevational view of the multiple discharge valving arrangement as seen along line 53—53 of FIG. 52.
Figure 52:
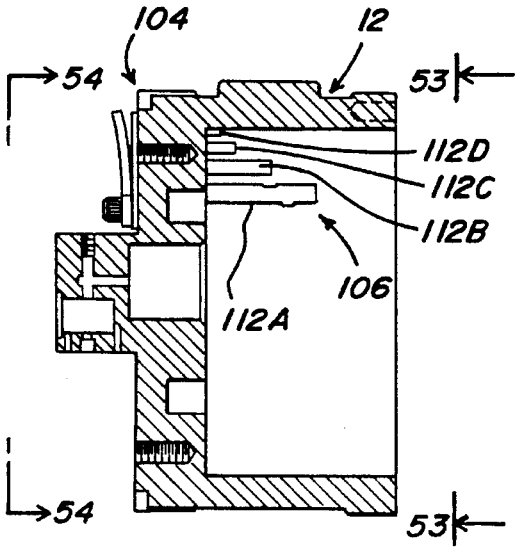
FIG. 52 is an axial sectional view of a multiple discharge valving arrangement of the fluid displacement machine of FIG. 1.

An innovative spin-off of this self-seating vane tip embodiment that also easily provides very close tip clearances is to configure the very outer-most tip region of the vane tip insert, as shown in FIGS. 44–46. This configuration uses micro-sized prominences or protrusions 82 separated by corresponding micro-grooves 84 in the extreme outermost region of the vane tip insert segment that run the length of the vane tip. The role of these micro-protrusion 82 and grooves 84 is that they will take a rapid final set and quickly offer a light "brushing" sealing effect at the vane tip if the vane material possesses such properties as thermoplastic materials, such as Nylon or Teflon. Further, more brittle materials such as plain and reinforced thermoset polymers, carbon-graphite, and ceramics, can also be used that simply sacrifice themselves during initial operation to achieve an essentially zero-clearance condition. What is particularly attractive about the axial micro-groove configuration is that it offers especially effective gas sealing due to the labyrinth effect of the grooves—while offering much larger allowable stack-up manufacturing tolerances.

Note that a similar zero-clearance condition can also be achieved by each of the rotor faces and each of the vane sides by applying similarly-configured (micro-grooved) crushable or abraidable inserts.

Coalescing Lubricant Separator and Sump Arrangement

Referring to FIGS. 3, 4 and 47–51, there is illustrated another improved feature in the form of a lubricant separator and sump arrangement 86 employed in fluid displacement machine 10. The arrangement 86 includes a separator cavity 88 having a sump 90 and a lubricant separator and filter element 92 with drain and outlet baffles 94, 96 disposed in the separator cavity 88 above the sump 90.

The stator housing body 18 is cup-shaped with the integral endplate 26 defining the bottom of the cup. The integral endplate 26 is "built in" to the stator housing 12, thus not only yielding a much stronger physical structure, but also eliminates endplate alignment problems as well as additional fasteners. The rear side of the housing body 18 also has an annular extension 98 attached to and extending rearwardly from the integral endplate 26 which defines the lubricant separator cavity 88 and sump 90. A cover 100 is provided for the separator cavity 88 and is shown fastened across the rear opening of the annular extension 98.

The machine 10 as a compressor uses a special lubricant-in-gas coalescing-separation element 92 that effectively separates entrained lubricant from the gas being compressed by the compressor. Such coalescing elements, per se, are manufactured by many companies including Temprite, Inc. and Microdyne Corporation. In addition to high effectiveness and high efficiency lubricant separation, the coalescing element also automatically provides a very high level of particulate filtration. The compressed discharge gas emerging from the interior compressor cavity 28, along with entrained lubricant, flows into a disc-shaped separator cavity 88 that is formed by the rear extension 98 of the housing body 18 of the stator housing 12 and the front surface of the combination coalescing lubricant separator and filter element 92. The discharge mixture of combined lubricant and gas then flows axially rearward through the coalescing element 92. The left-pointing arrows A appearing in FIG. 47 represent the lubricant-laiden gas as it flows orthogonally to and through the combination coalescing element. The lubricant droplets that are coalesced from the highly-entrained inlet gas during its passage through element 92 collect in the drain baffle 94 into the sump 90. As noted by the vertical arrows B in FIG. 47, the lubricant-free gas then exits upward, across the outlet baffle 96, and out through the discharge fitting. In the meantime, the separated lubricant that flows through the drain baffle 94 enters the coalesced lubricant region or sump 90 behind the coalescing element 92. The chamber upstream of the coalescing element 92 is well sealed so that by-passing of the coalescing element 92 is avoided. The liquified and coalesced lubricant that collects in the bottom of sump 90 then flows into the oil return tube 102, into the stator lubricant distribution hole, and then into the expanding volume regions that develop in the vane slots (under the vane heels) during the suction process. As the rotor-vane assembly continues to rotate, these same volume regions within the vane slots 44 begin to contract during the compression process. Therefore, as the lubricant enters the compressor region itself, it is automatically pumped via the action of vane set throughout the machine. Due in large part to the relatively large thickness of vanes 16, the pumping action of the vanes 16 in the rotor slots 44 is especially active and results in superior distribution of the lubricant within dynamic vane and vane slot interface, as well as throughout the machine.

Further, by suspending desiccant within (or adjacent to) the matrix of the coalescing element 92, it will provide a further and important function: elimination of migrant moisture from refrigeration and air conditioning systems. Thus, the new combined lubricant management element employed herein eliminates a costly subcomponent (the filter-dryer) that must be installed in the plumbing of air conditioning and refrigeration systems served by conventional compressors.

The reason that lubricant flows naturally into the central region of the machine 10 without the use of a separate lubricant pump is two-fold: (a) the lubricant is purposely being trapped at the highest pressure in the system; and (b) the very significant pumping action of the extraordinarily wide vanes common to this new type of machine ensures a lower central machine pressure. Thus, by design, the lubricant will flow into the machine and circulate through the interfaces requiring its lubricity and sealing actions. Finally, of course, this lubricant is then again discharged, along with the compressed gas, through the discharge outlet and, ultimately, into the coalesced lubricant separator cavity 88. It should be noted that this is essentially a passive "fail-safe" lubricant system: its own generated gas pressure causes the continual flow of lubricant, but only when the machine is operating and thus in need of lubrication—all without a special or dedicated oil pump.

Multiple Discharge Valving Arrangement

Referring to FIGS. 2–4 and 52–54, there is illustrated still another improved feature in the form of a multiple discharge valving arrangement 104 employed in the fluid displacement machine 10. This arrangement meets the earlier-discussed stiff design constraints of low cost and high reliability for the automotive air conditioning compressor market by providing an exceeding simple and yet surprisingly efficient mechanism. This arrangement complements a desirable inherent attribute of the rotary vane-type compressor machine 10 which is to cause the dischage volume of gas therein to decrease to zero during the discharge flow process. This attribute is in sharp contrast to the inability of a piston-type compressor machine to accomplish this. Instead, inherently a "clearance volume" remains in order to prevent the top of the piston from impacting the head of the cylinder enclosing the piston. The reason why it is important to completely discharge the gas is because any residual compression volume remaining will have to flow back into the subsequently discharging volume and require additional compression input power to operate the compressor. Thus, the "back-flow" process increases the thermodynamic work requirement which, of course, decreases energy efficiency. Further, the presence of a residual "back-flow" volume causes the final discharge temperature of the gas to be elevated over what it would have been in the absence of such volume.

The multiple discharge valving arrangement 104 includes a plurality of discharge ports 106 defined in the stator housing 12 and an assembly of multiple reed valves 108 mounted on the housing integral endplate or wall 26 over the exit ends of the discharge ports 106. The reed valves 108 are separately actuable between opened and closed positions relative thereto. The discharge ports 106 are sequentially encountered by a respective approaching vane 16 which is moving with the rotating rotor 14. That is, the first discharge port 106A in the sequence is encountered first by the discharging vane volume whereas the second, third and fourth discharge ports 106B, 106C, 106D are thereafter sequentially encountered. Each discharge port 106 is composed of two contiguous but identifiable portions 110, 112. The first portion 110 is a full cylindrical hole that continues from the annular interior surface 22 of the stator housing 12 through the endplate 26 to the exterior thereof. The second portion 112 is essentially a half- or semi-cylindrical depression or recess formed in the annular interior surface 22 of the stator housing 12. The axial lengths of these second portions 112A–112D vary in a linear relationship from one port to the next. Specifically, the first encountered semi-cylindrical depression 112A is the longest, while the fourth or last encountered semi-cylindrical depression 112D is the shortest.

The reasons for this multi-variable length discharge port configuration is as follows. As a set of two vanes 16 which encompasses a compressing volume segment continues its clockwise rotation, the leading vane of this pair eventually reaches the first discharge port 106A. If the pressure in the sump region is below the pressure in the compressing vane volume segment, the gas contained within that volume segment will flow into the second half-cylindrical portion 112A of the first discharge port 106A and on into its first full-cylindrical portion 110A and lift the corresponding one of the thin reed valves 108 aligned therewith and thus discharge the gas into the separator cavity 88. Continued rotor rotation then sequentially uncovers the succeeding discharge ports 106.

If the pressure within the separator cavity 88 is above the pressure in the compressing vane volume as it first passes the first port (as is more generally the case), then the vane volume segment simply continues to rotate and compress as the next ports are encountered. Finally, at some angular location, the pressure within the mechanically-compressing vane volume segment will rise above the pressure within the separator cavity 88 and open the individual discharged reed valves 108 and thus discharge the gas into the separator cavity 88.

The reason the second half-cylindrical recess portion 112A of the first encountered discharge port 106A is the longest is that it specifically provides the largest circumferential cross-sectional flow area for the discharging gas to change direction from a generally circumferential location (clockwise, for example) to a rearward axial direction as it proceeds through the half-cylindrical portion of the first discharge port 106A and on to the full-cylindrical portion thereof. Thus, the first port 106A is longest because the rate-of-change of the discharging vane volume segment (and, therefore, its pumping rate) is largest and diminishes with each succeeding degree of clockwise angular location. Thus, when the second discharge port 106B is encountered (uncovered), less mass/volume pumping is required, so the half-cylindrical portion of the second port can be shorter. This, of course, minimizes the amount of volume of gas that can spill back ("back flow") into the next compressing vane volume segment—an important part of optimizing the performance of the discharge ports as discussed above. This situation continues until all ports are subtended by the vane volume segment, and gas delivery proceeds through all four (in this example) discharge ports 106.

Another important aspect of the simple design of this arrangement is its great ease of manufacture: these ports can be cast directly into the stator housing 12 without any secondary machining required. Note further that not only is this discharge port embodiment exceedingly simple, it is especially "hard" and robust. In addition, the reed valve assembly is simply mounted on the rear of the stator intermediate endplate 20 as a simple subassembly. Further and importantly from the standpoint of reliability this rear-mounted reed valve assembly is in no danger of ever invading the innards of the compressor cavity, even if it were to physically break away from its mount. Note also that the half-cylindrical portions of these discharge ports can take on tapered shapes which are more streamlined thus achieve even better flow turning and present even less spill-back residual compression volume.

Therefore, in the normal operation of the machine (as a compressor) 10, inlet gas enters the stator housing 12 through an inlet port 114, flows via a suction channel 116, and is compressed in the interior bore 20 by the rotation (in a clockwise direction as viewed in FIG. 2) of the rotor 14 and shaft 36 and the set of radially movable vanes 16 carried therewith. Continued rotation of the rotor 14 increases the pressure within the trapped gas vane slots or chambers until it is sufficient to lift the thin reed valves 108. As the reed valves 108 lift, the compressed discharge gas flows through the axial discharge half-cylindrical recesses 112 defined through the internal end plate 26 of the stator housing 12 and through the reed valves 108. A significant attribute of this arrangement is that the four sequential discharge ports 106 effectively section or chop the discharging gas flow into segments, even if all valves open at once, which tends to quiet the operation of the compressor. With four vanes 16 and four discharge ports 106, the discharging gas flow is effectively sectioned into sixteen smaller pulses per revolution, thus further lowering the operating noise.

Consolidated Low Profile Vane Guide Assembly

Referring to FIGS. 55–65, there is illustrated another improved feature in the form of a consolidated low profile vane guide assembly 118 which in pairs are provided for positioning the vanes 16 of the machine 10. Each low profile vane guide assembly 118 incorporates constructional features which increase manufacturability and decrease the cost of the machine 10. The glider 58 of the previous design of the vane guide assembly 46 seen in FIGS. 2–4 has a hole to accommodate the end of the axle 60. The presence of the hole results in a relatively wide glider 58 which, in turn, requires a relatively large glider bearing 48. Due to the relatively large size of the attendant glider bearing 48, the inner facing lip of this bearing must provide a considerable portion of the rotor-to-endplate sealing surface. In the absence of dynamic gaskets 62 and 64 (FIGS. 3 and 4), this requirement necessitates the precision grinding of the inner facing bearing lip as well as its precision "flush" placement in the endplates 24, 26.

Thus, in the event that a substantially smaller radial profile glider roller bearing could be used, there would be adquate rotor-to-endplate sealing surface available on the endplates without requiring additional sealing surface from the inner lips of the glider bearings or dynamic gaskets 62 and 64. This situation would not only relieve the need for grinding the glider bearing inner lip but would also eliminate the necessity of pressing the bearings in exactly flush relationship with the inner surface of the endplate surfaces. That is, since enough rotor-to-endplate sealing surface would be available with a small enough glider bearing, the bearing would simply be pressed in past the endplate surfaces enough to ensure that there would be no dimensional interference with the rotor faces or ends of the vanes. Therefore, this would result in a further increase in manufacturability and an attendant decrease in cost.

The aforementioned improvement is achieved herein through the provision of the consolidated low profile vane guide assembly 118, as seen in FIGS. 55–65. The consolidated vane guide assembly 118 includes a pair of combined axle glider segments 120. Each segment 120 has a one-piece construction. Each segment 120 includes a stub axle portion 122 and a glider portion 124 rigidly and fixedly connected to one of the opposite ends of the stub axle portion 122. In view of this construction of each segment 120, there is no need to provide a hole in the glider portion 124 to rotatably receive the stub axle portion 122. Thus, the glider portion 124 of FIGS. 55–65 can be provided with a substantially shorter height than the glider 58 of the previous construction shown in FIGS. 2 and 3. In fact, the height of the glider portion 124 can be less than the diameter of the stub axle portion 122.

Figure 55:
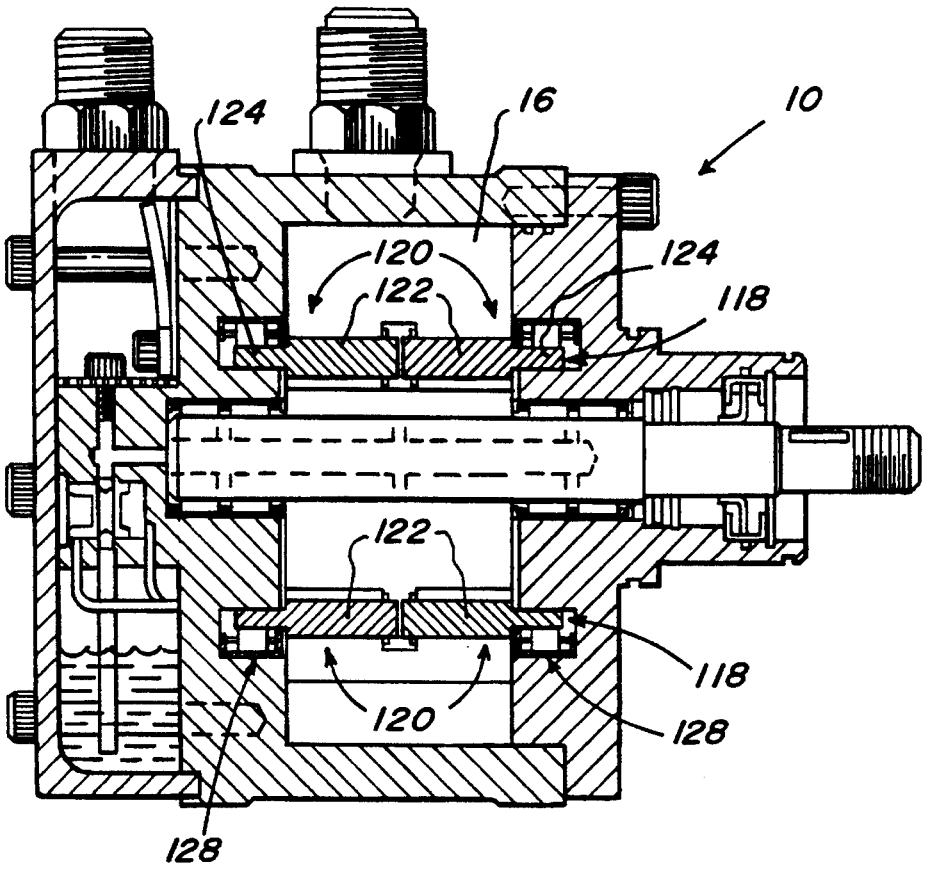
FIG. 55 is an axial sectional view of another embodiment of the fluid displacement machine employing a plurality of low profile vane guide assemblies.
Figure 56:
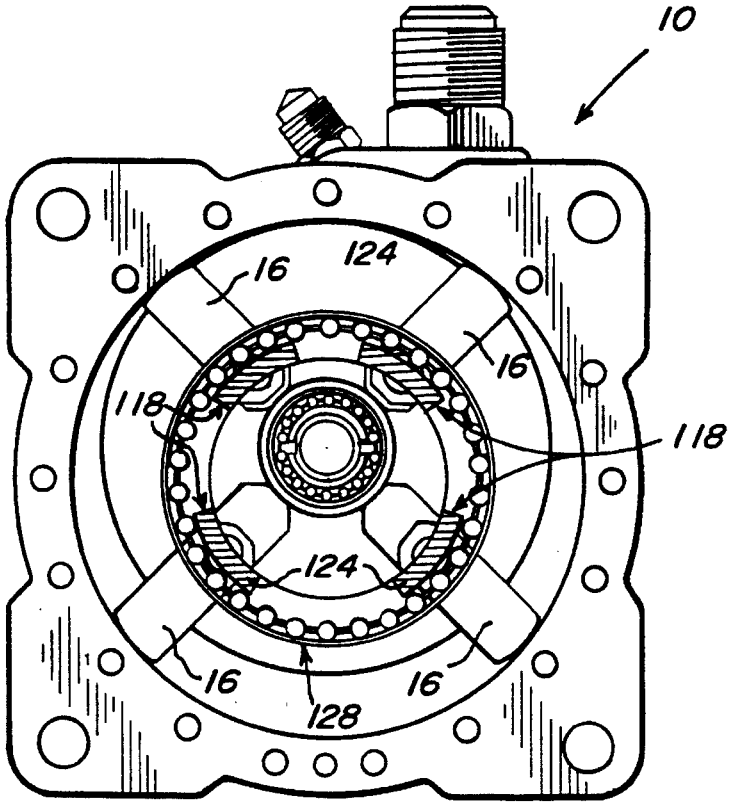
FIG. 56 is a frontal cross-sectional view of the embodiment of the machine of FIG. 55.
Figure 57:
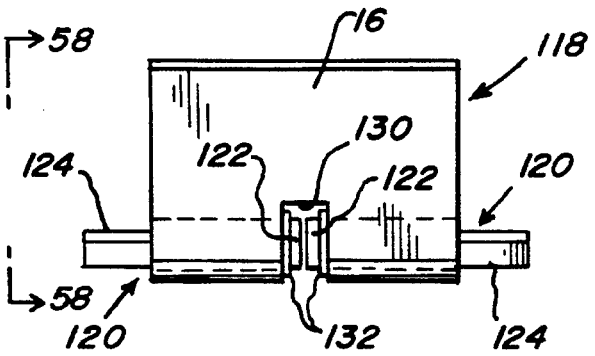
FIG. 57 is a side elevational view of one of a plurality of low profile vane guide assemblies removed from the machine of FIG. 55.
Figure 59:
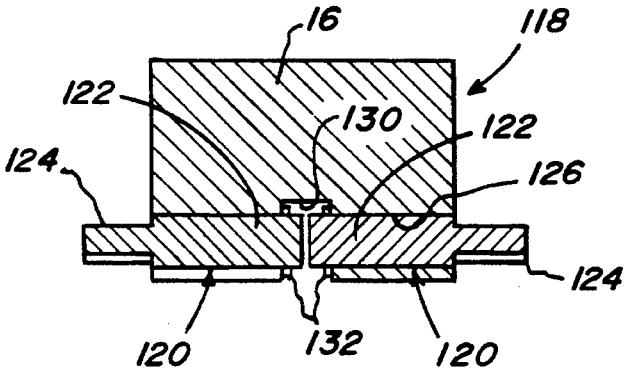
FIG. 59 is an axial sectional view of the vane guide assembly taken along line 59—59 of FIG. 58.
Figure 58:
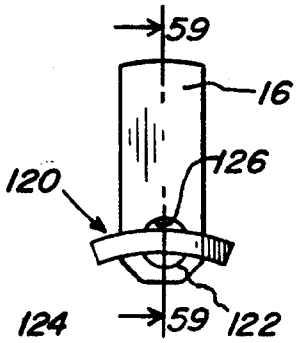
FIG. 58 is an end elevational view of the vane guide assembly as seen along line 58—58 of FIG. 57.
Figure 63:
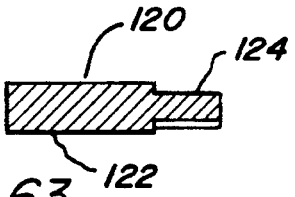
FIG. 63 is an axial sectional view of the axle glider segment taken along line 63—63 of FIG. 61.
Figure 62:
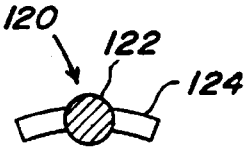
FIG. 62 is another cross-sectional view of the axle glider segment taken along line 62—62 of FIG. 60.
Figure 60:
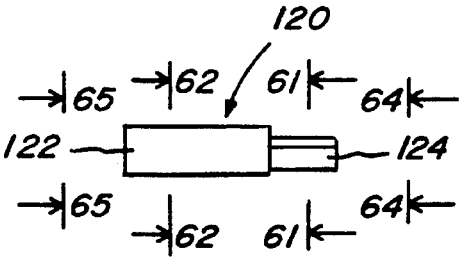
FIG. 60 is a side elevational view of one of a pair of combined axle glider segment of the vane guide assembly of FIG. 55.
Figure 61:
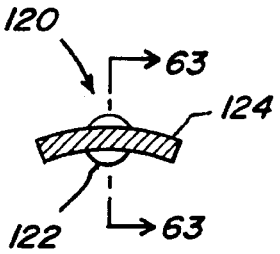
FIG. 61 is a cross-sectional view of the axle glider segment taken along line 61—61 of FIG. 60.
Figure 65:
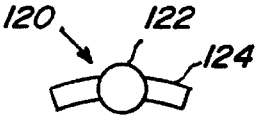
FIG. 65 is an opposite end elevational view of the axle glider segment as seen along line 65—65 of FIG. 60.
Figure 64:
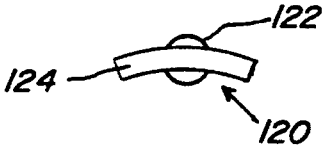
FIG. 64 is an end elevational view of the axle glider segment as seen along line 64–64 of FIG. 60.
Figure 68:
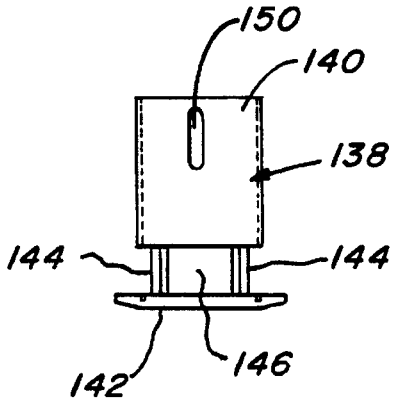
FIG. 68 is a side elevational view of a flow check member of the check valve assembly of FIG. 66.
Figure 69:
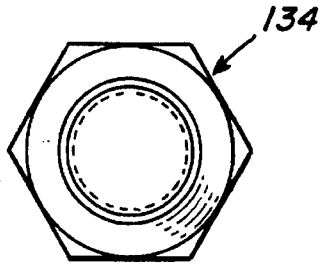
FIG. 69 is a top plan view of the check valve assembly as seen along line 69—69 of FIG. 66.

The stub axle portion 122 fits through about one-half of the length of an axial hole 126 defined through the inner portion of the vane 16 and the glider portion 124 is disposed at the respective one of the opposite ends of the vane 16 and rides inside of a reduced-size roller bearing 128, as shown in FIGS. 55 and 56. The middle of the underside of the vane 16 has a notch 130 formed therein which exposes the inner ends of the stub axle portions 122 and facilitates insertion of retainers 132, such as C-rings, thereon to retain the stub axle portions 122 within the axle hole 126 of the vane 16.

As can be observed by comparison of FIGS. 55 and 56 with FIGS. 2 and 3, the provision of the low profile design of the glider portion 124 of the vane glider assembly 118 permits the use of a glider bearing that is smaller than in the previous design. This smaller bearing greatly increases the clear seal area/leakage path in the peripheral region of the lower portion of the rotor 14. Since the rotor-to-endplate leakage path is much longer now than that available in the earlier design, the glider bearing can be pressed below the endplate sealing surfaces, thus easing the production tolerances of the components.

Another attribute of the low profile vane guide assembly 118 is that not only does it provide for a smaller vane glider roller bearing and the attendant advantages, it also significantly increases the diameter of the endplate glider hub shown in FIG. 55 compared to the earlier hub 54 shown in FIG. 2 (the hub being the central portion of the respective endplate surrounded by the annular channel 50 which receives the bearings and gliders). This enlarged hub yields two separate and significant advantages: first, larger main shaft rotor bearings can be used for longer compressor life; and, second, the section thickness between the top of the ID of the main shaft bearing and the top of the endplate/glider hub is increased. This latter advantage turns out to be of interest when pressing the main shaft bearing into the endplate groove and over the hub, especially if it is made from relatively soft and light materials, such as aluminum. This is because, if the section is too thin, the stress and accompanying strain resulting from pressing the main shaft bearing into the endplate will bulge the thin top region enough to interfere with the passage of the glider inside of the glider bearing and the hub.

Thus, the use of the low profile vane guide assembly 118 offers the aforementioned advantages. In addition thereto, it results in a basic reduction in the number of parts. The previous design required one vane axle, two gliders, two spacers, and two bearing retainers for a total of seven parts. The new low profile design disclosed herein requires only two pieces plus two retainer elements for a total of four parts. It is possible that even the retainers can be eliminated because the outward axial travel of the composite glider can be controlled by the outward-facing surface of the stub-axle portion acting against the lip of the glider roller bearing. Accompanying the reduction in the number of parts is also a reduction in the number of tolerance stack-ups because fewer parts require fabrication.

Suction Flow Check Valve Assembly

Referring to FIGS. 66–69, there is illustated still another improved feature in the form of a suction flow check valve assembly 134 for use in the machine 10. A problem arises in that when the machine shuts down, the lubricant in the lube sump 90, which is at high pressure, will continue to flow into the machine 10. At re-start, accumulated lubricant can cause hydraulic damage or locking within the machine. Typically, a conventional suction check valve is placed in the suction line to solve this problem. When the check valve suddenly closes at shut-down, the gas pressure in the sump (from the condenser in an air conditioner or refrigeration application or a storage tank in an air compression system) will quickly rise in the relatively small compressor volume, thus eliminating the pressure difference which causes the lubricant flow.

The classical problem with such use of a suction check valve is that it causes pressure losses during the inlet gas flow process. Suction pressure loss is especially odious because it directly decreases the volumetric efficiency—and therefore, the overall capacity and energy efficiency—of the compressor. For example, during a pressure loss of only one psi through a suction check valve, say from 40 psig to 39 psig, the specific density of the refrigerant vapor of HFC-134*a* drops from 1.056 lb/ft$^3$ to 1.036 lb/ft$^3$. This loss of refrigerant density cuts the efficiency immediately by 2 percent. More realistic actual pressure losses through suction check valves can easily degrade performance by 5%.

Figure 67:
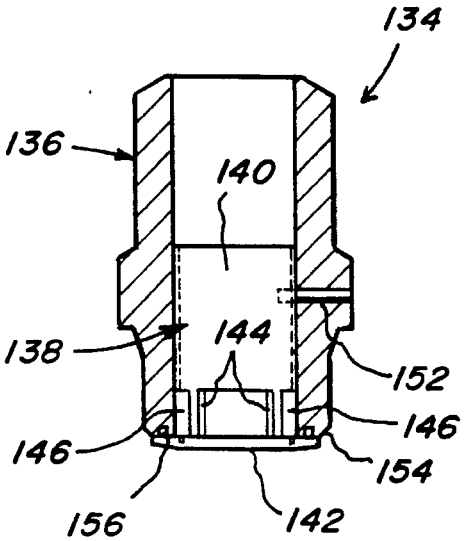
FIG. 67 is another axial sectional view of the suction flow check valve assembly shown in a closed condition.
Figure 66:
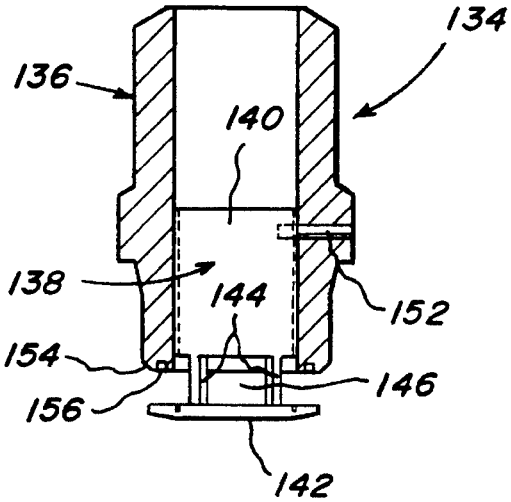
FIG. 66 is an axial sectional view of a suction flow check valve assembly for employment in the fluid displacement machine of FIG. 1, showing the check valve in an opened condition.

The improved suction check valve assembly 134 shown in FIGS. 66 and 67 imposes essentially zero pressure loss on the suction flow. Rather than having to work against a spring or magnet, the valve assembly 134 is opened automatically by the force of gravity, even at significant inclines. Upon compressor shut-down, the valve assembly 134 automatically closes as high pressure gas attempts to flow back into the low pressure (suction) region, thus ensuring that excess lubricant will not flow into the compressor cavity of the machine 10.

More particularly, the suction check valve assembly 134 includes an outer check valve fitting body 136 and an inner valve closure element 138. The inner closure element 138 includes a cylindrical slide body 140 and a horizontal seal plate 142 connected to one end of the slide body 140 via a plurality of extension legs 144 which extend parallel with one another but are spaced circumferentially from one another. Rectangular arcuate spaces 146 are defined between the extension legs 144 so as to provide a very large flow area for the inward flow of suction gas into the compressor cavity 28 of the stator housing 12. This flow area is approximately three times the cross-sectional throat area of the slide body 140 itself and so provides virtually no resistance to inlet gas flow.

The cylindrical slide body 140 of the inner closure element 138 fits relatively snugly inside of a bore 148 through the fitting body 136, but is free to easily slide vertically therein. A motion-limiting slot 150 is defined in the slide body 140 in alignment with and receiving an inward extension of a stop pin 152 which is securely mounted through the fitting body 136. Thus, in the open condition (when the inner closure element 138 is in the lowered position shown in FIG. 66, the combined action of the motion-limiting slot 150 and the stop pin 152 prevent the inner closure element 138 from falling out of the fitting body 136, and yet provides a large gas flow area.

The valve fitting body 136 has a lower lip 154 seating an O-ring 156. Thus, when the machine 10 is turned off, the sudden back-rush of gas from within the compressor cavity 28 causes the relatively light inner closure element 138 to quickly slide upwards. This upward motion stops when the upper surface of the seal plate 142 compresses and seals against the O-ring 156 placed within the bottom lip 154 of the valve fitting body 136, thus very effectively sealing the gas within the compressor cavity 28 itself. As noted above, the closure of this check valve assembly 118 causes the pressure within the compressor interior cavity 28 to rise rapidly to the pressure within the lubricant sump region 90, thus stopping lubricant from flowing from the sump to the compressor cavity 28 and thus preventing possible damage at re-start.

Also, it should be noted that a fine-mesh filter screen in the configuration of a cylinder can be placed inside of the slide body 140 of the inner closure element 138 to prevent the ingestion of particles of contamination. Such added screen provides both a very simple check valve and a significant level of filtering without incurring significant pressure loss.

A further advantage of the disclosed check valve assembly 118 is that it actually doubles as a plumbing line fitting. Further, note should be made that the fitting body 136 of the check valve assembly 118 could be built into the suction region of the stator housing 12 instead of being placed therein by a separate fitting.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A non-contact vane type fluid displacement machine, comprising:

(a) a stator housing having an annular interior wall surface defining an interior bore having a longitudinal axis and a pair of opposing flat interior wall surfaces extending in transverse relation to said annular interior wall surface and said longitudinal axis and closing opposite ends of said interior bore;

(b) a rotor supported in said interior bore of said stator housing between said opposing flat interior wall surfaces thereof and in an eccentric position relative to said annular interior wall surface thereof to undergo rotation relative to said stator housing about a central rotational axis laterally offset from said longitudinal axis, said rotor having a pair of opposite flat end surfaces, an annular outer surface extending between said opposite flat end surfaces, and at least one slot defined therein extending radially from said annular outer surface toward said central rotational axis and axially between said opposite flat end surfaces;

(c) at least one vane disposed in said slot of said rotor to undergo reciprocable movement in a radial direction relative to said central rotational axis of said rotor such that an outer tip portion of said vane is maintained in a non-contacting substantially sealed relationship with said annular interior wall surface of said stator housing; and (d) a pair of separate, unitary, one-piece vane guide combined axle glider segments for positioning said one vane in said slot of said rotor, each of said vane guide segments supporting a portion of said one vane and having (i) a glide portion supported in one of a pair of annular channels arranged concentrically about said central rotational axis of said rotor and defined in one of said opposing flat interior wall surfaces of said stator housing, and (ii) a stub axle portion rigidly attached at an outer end thereof to said glider portion and each stub axle portion fitting into a separate portion of the length of an axial hole defined through an inner portion of said vane; said vane further having a notch formed therein at about a middle location along an underside of said inner portion thereof such that inner ends of said stub axle portions are exposed to receive a retainer element so as to retain said stub axle portions within said hole of said vane, said glider portion having a height less than a diameter of said stub axle portion, and said glider portion of each of said combined axle glider segments is disposed at the respective one of a pair of opposite ends of said vane and is supported in one of said annular channels.

* * * * *